US007673747B2

(12) United States Patent
Yoda

(10) Patent No.: US 7,673,747 B2
(45) Date of Patent: Mar. 9, 2010

(54) MOLDED PULP CONTAINER

(75) Inventor: Kenji Yoda, Kanagawa (JP)

(73) Assignee: Sony computer Entertainment Inc., Tokyo (JP)

( * ) Notice: Subject to any disclaimer, the term of this patent is extended or adjusted under 35 U.S.C. 154(b) by 244 days.

(21) Appl. No.: 11/406,808

(22) Filed: Apr. 19, 2006

(65) Prior Publication Data

US 2006/0289665 A1 Dec. 28, 2006

Related U.S. Application Data

(60) Provisional application No. 60/685,273, filed on May 27, 2005.

(51) Int. Cl.
*B65D 85/00* (2006.01)

(52) U.S. Cl. ..... 206/320; 206/722; 206/521; 220/520

(58) Field of Classification Search ..... 206/521, 206/320, 576, 701, 722, 723, 587, 591, 592, 206/593; 220/520, 523, 525, 526
See application file for complete search history.

(56) References Cited

U.S. PATENT DOCUMENTS 2,446,264 A * 8/1948 Cox ..... 206/521.1
2,739,750 A * 3/1956 Cox ..... 206/521.8
2,843,304 A * 7/1958 Reifers ..... 206/521.1
2,865,548 A * 12/1958 Stewart ..... 206/521.8
2,885,135 A * 5/1959 Friday ..... 229/406
3,294,270 A * 12/1966 Geisler ..... 217/21
3,651,976 A * 3/1972 Chadbourne ..... 220/23.4
3,963,172 A * 6/1976 Holzwarth et al. ..... 206/521.1
4,609,141 A * 9/1986 Lake ..... 206/521.1
4,821,874 A * 4/1989 Uhlig ..... 206/140
5,127,526 A * 7/1992 Vigue ..... 206/587
5,244,094 A * 9/1993 Graff et al. ..... 206/564
5,323,898 A * 6/1994 Kester ..... 206/709
5,323,926 A * 6/1994 Pomroy et al. ..... 220/526
6,042,000 A * 3/2000 Kawamoto ..... 229/406
2003/0080023 A1 * 5/2003 Slot ..... 206/588

* cited by examiner

*Primary Examiner*—Jacob K Ackun, Jr.
(74) *Attorney, Agent, or Firm*—Katten Muchin Rosenman LLP

(57) ABSTRACT

The invention provides a container which can store a product which is constituted of a plurality of devices therein integrally and in a compact manner, and can also facilitate the packing of the product. A molded pulp container includes a storing recessed portion which has an opening at an upper surface thereof and is molded in conformity with a shape of a first material to be stored, a partition portion which is connected to the brim portion of the opening of the storing recessed portion and is foldable toward the storing recessed portion side to be placed on at least a portion of the brim portion of the storing recessed portion and, at the same time, forms a base on which a second material to be stored is placed, and a lid portion which is molded in conformity with a shape of the second material to be stored and is connected to the brim portion formed on the storing recessed portion and is folded to the storing recessed portion side to cover the partition portion from above.

11 Claims, 10 Drawing Sheets

MOLDED PULP CONTAINER

CROSS REFERENCE TO RELATED APPLICATION

This application claims priority from U.S. Provisional Application 60/685,273, filed May 27, 2005, the contents of which are hereby incorporated by reference.

BACK GROUND OF THE INVENTION

1. Field of the Invention

The invention relates to a molded pulp container, and more particularly to a container which stores a product which is constituted of a plurality of devices in a compact manner.

2. Description of the Related Art

In providing a relatively light-weight electrical product (for example, a portable gaming device or a portable music reproducing device) or the like in a form where the electrical product is packed in a transportation package to a consumer, to absorb shock which the electric product is likely to receive during the transportation, in many cases, the electrical product is stored in a container made of cardboard, foamed styrene or the like and is supported in the inside of a package.

However, when the product which is provided to the consumer is constituted of a plurality of devices, in an attempt to support these devices in the inside of one package using the cardboard and to absorb the shock at the time of transportation, a shape of the cardboard becomes complicated. For example, when the product is constituted of a product body and accessories, it is necessary to bend many portions of the cardboard in conformity with shapes of the product body and the accessories so as to wrap these product body and accessories. Further, to absorb the shock at the time of transportation, it is necessary to form a plurality of projections on the cardboard by bending the cardboard at many portions thereof and to bring these projections into contact with the package. Accordingly, a packing operation becomes cumbersome. Further, once the consumer takes out the product body and the accessories from the package together with the cardboard and opens the cardboard one time, it is difficult for the consumer to make use of the cardboard by returning the cardboard to an original shape.

Further, in a packing operation which uses the formed styrene in place of the cardboard, different from the cardboard, it is impossible to bend the formed styrene, and hence it is necessary to prepare a plurality of formed styrene parts in conformity with the shapes of the respective devices. Accordingly, the number of formed styrene parts is increased thus exhibiting poor packing efficiency.

In this respect, with the use of a pulp mold as a container of a product, it is possible to preliminarily impart a shape which conforms to shapes of various devices to the container and has a shock absorbing effect. Accordingly, it is possible to simplify the shape of the container compared to the cardboard. Further, the number of parts can be reduced compared to the foamed styrene.

However, with respect to the conventional container which uses the pulp mold, as in the case of a container which is used for food stuffs such as eggs and fruit, a plurality of items to be stored are arranged longitudinally as well as laterally and are respectively held in such an arrangement. Accordingly, longitudinal and lateral sizes of the container are increased thus giving rise to a drawback that the transportation of the container and the display of the product are inconvenient.

SUMMARY OF THE INVENTION

The invention has been made to overcome the above-mentioned drawback and it is an object of the invention to provide a container which can store a product which is constituted of a plurality of devices integrally and in a compact manner thus facilitating a packing operation of the product.

To overcome the above-mentioned drawback, a molded pulp container according to the invention is characterized by including a storing recessed portion which has an opening at an upper surface thereof and is molded in conformity with a shape of a first material to be stored, a partition portion which is connected to the storing recessed portion by a first bending brim portion formed on a portion of a brim of the opening and is foldable toward the storing recessed portion side at the first bending brim portion to be placed on at least a portion of the peripheral portion of the storing recessed portion and, at the same time, forms a base on which a second material to be stored is placed, and a lid portion which is molded in conformity with a shape of the second material to be stored, is connected to the storing recessed portion by a second bending brim portion formed on another portion of the peripheral portion of the storing recessed portion and is foldable to the storing recessed portion side at the second bending brim portion to cover the partition portion from above.

According to the invention, the first material to be stored is stored in the storing recessed portion and the second material to be stored is stored above the first material to be stored in a state where the second material to be stored is placed on the partition portion, and hence it is possible to store a product which is constituted of a plurality of devices in a compact manner.

Here, the first material to be stored and the second material to be stored may be a product body and an accessory, respectively. For example, the product body may be any one of various electrical appliances including a gaming device, a music reproducing device, a camera, a mobile phone and the like, while the accessory may be a device which is used in an affiliated manner with the product body such as a battery, an adaptor, an information storage medium or the like. Here, the numbers of the product body and the accessory are not limited to one for each and may be two or more for each. The partition portion is formed in a plate-like shape or is formed in an irregular shape in conformity with the shapes of the first material to be stored and the second material to be stored. With respect to a mounting position of the partition portion on the storing recessed portion, any position on the brim portion of the storing recessed portion is selected so long as the partition portion is foldable toward the storing recessed portion side at the first bending brim portion. Further, with respect to a mounting position of the lid portion on the storing recessed portion, any position on the brim portion of the storing recessed portion is selected so long as the lid portion is foldable toward the storing recessed portion at the second bending brim portion and, at the same time, the mounting position differs from the partition-portion connecting position.

Further, according to one aspect of the invention, the storing recessed portion and the lid portion are, in a state before the lid portion is folded to the storing recessed portion side, recessed in the same direction from the respective brim portions. In this aspect of the invention, since the recessing directions of the storing recessed portion and the lid portion are equal to each other, a manufacturing step such as press forming is facilitated.

Further, according to another aspect of the invention, the partition portion is molded in conformity with an end surface shape of the second material to be stored. In this aspect of the invention, at the time of transporting a product or the like, it is possible to suppress the tilting of the second material to be stored on the partition portion and hence, the container can increase a strength of holding the second material to be stored in the inside thereof. Further, the position on the partition portion at which the second material to be stored is to be placed is preliminarily determined, thus facilitating the packing operation.

Further, in this aspect, the storing recessed portion, the lid portion and the partition portion may be, in a state where the container is developed, recessed in the same direction from the respective brim portions. Due to such a constitution, since the recessing directions of the storing recessed portion, the lid portion and the partition portion are equal to each other, the manufacture of the container is further facilitated. Here, the state where the container is developed implies a state in which the partition portion and the lid portion are not folded toward the storing recessed portion side, and hence the respective portions are not yet overlapping each other, that is, a state in which the container is not yet assembled.

Further, according to another aspect of the invention, the storing recessed portion, the lid portion and the partition portion are integrally molded. In this aspect of the invention, since the container is integrally molded, the number of parts of the container can be reduced to only one, thus facilitating the manufacture of the container and, at the same time, facilitating the packing operation of the first material to be stored and the second material to be stored.

Further, according to another aspect of the invention, the brim portion of the storing recessed portion is formed in a flange shape which extends outwardly. In this aspect of the invention, in addition to a shock absorbing function which the pulp mold intrinsically possesses, the brim portion of the storing recessed portion which is molded in a flange shape is brought into contact with the inside of a package which houses the container therein, and hence a shock absorbing effect of the container is increased.

Further, according to another aspect of the invention, the peripheral portion of the storing recessed portion, the peripheral portion of the partition portion and the peripheral portion of the lid portion are arranged on a coplanar plane. In this aspect of the invention, when the partition portion and the lid portion are folded back toward the storing recessed portion side, the peripheral portion of the storing recessed portion and the peripheral portion of the partition portion are brought into contact with each other without a gap and, at the same time, the peripheral portion of the partition portion and the peripheral portion of the lid portion are also brought into contact with each other without a gap. Accordingly, the aesthetic appearance of the container after the first material to be stored and the second material to be stored in the container can be enhanced and, at the same time, these materials to be stored can be more surely supported in the inside of the container.

Further, according to another aspect of the invention, the brim portion of the partition portion includes a convex lower engaging portion which projects upwardly in a state where the partition portion is folded toward the storing recessed portion side, while the brim portion of the lid portion includes an upper engaging portion which is engaged with the lower engaging portion, at a position where the lower engaging portion faces in a state where the lid portion is folded toward the storing recessed portion side. In this aspect of the invention, the upper engaging portion and the lower engaging portion are engaged with each other, and hence the lid portion is fixed to the partition portion making it possible to more surely support the materials to be stored in the inside of the container.

Further, in this aspect of the invention, the upper engaging portion may be formed in a convex shape which projects upwardly in a state where the lid portion is folded toward the storing recessed portion side, and the storing recessed portion, the lid portion, the upper engaging portion, the partition portion, and lower engaging portion, in a state where the container is developed, recessed in the same direction from the respective brim portions. Due to such a constitution, the recessing directions of the respective portions of the container are directed in the same direction from the brim portions, thus facilitating the manufacture of the container.

Further, according to another aspect of the invention, the container further includes a holding partition portion which is connected to the partition portion by a third bending brim portion which is formed on the brim portion of the partition portion, is folded toward the partition portion side at the third bending brim portion before the partition portion is folded toward the storing recessed portion side and, thereafter, is folded toward the storing recessed portion side integrally with the partition portion. In this aspect of the invention, the holding partition portion is folded toward the storing recessed portion side and is placed on the storing recessed portion integrally with the partition portion and hence, it is possible to realize the container which exhibits a strong resistance against an external force from the side.

Further, in this aspect of the invention, the holding partition portion may be molded in conformity with a shape of an end surface of the first material to be stored. Due to such a constitution, it is possible to suppress the tilting of the first material to be stored in the inside of the container.

Further, in this case, the storing recessed portion, the partition portion, the lid portion and the holding partition portion may be, in a state where the container is developed, recessed in the same direction. Due to such a constitution, the recessing directions of the storing recessed portion, the lid portion, the partition portion and the holding partition portion become equal, and hence the manufacture of the container can be further facilitated.

DESCRIPTION OF THE PREFERRED EMBODIMENTS

Hereinafter, one embodiment of the invention will be explained in detail in conjunction with drawings.

Figure 1:
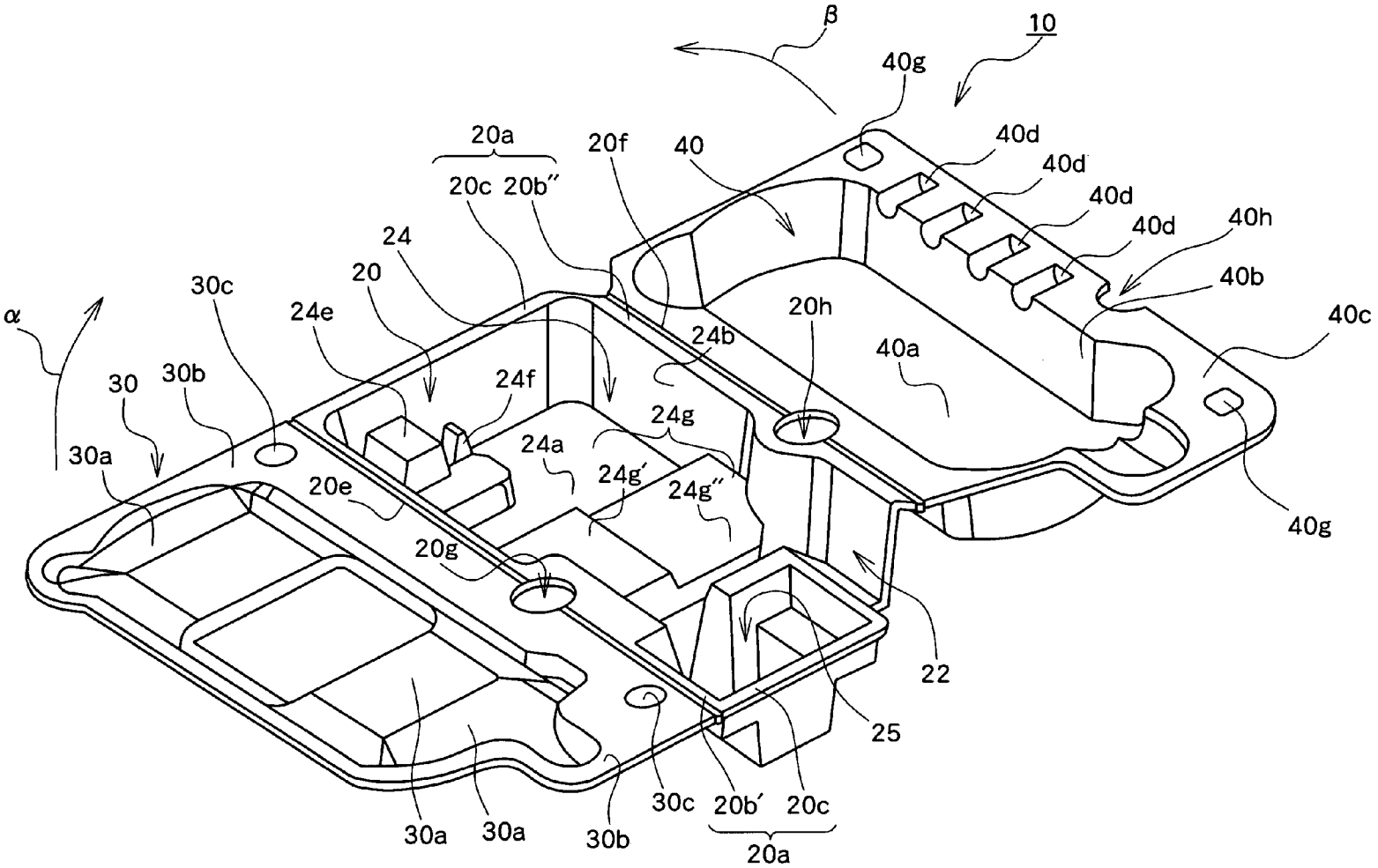
FIG. 1 is a perspective view of a container according to one embodiment of the invention.
Figure 2:
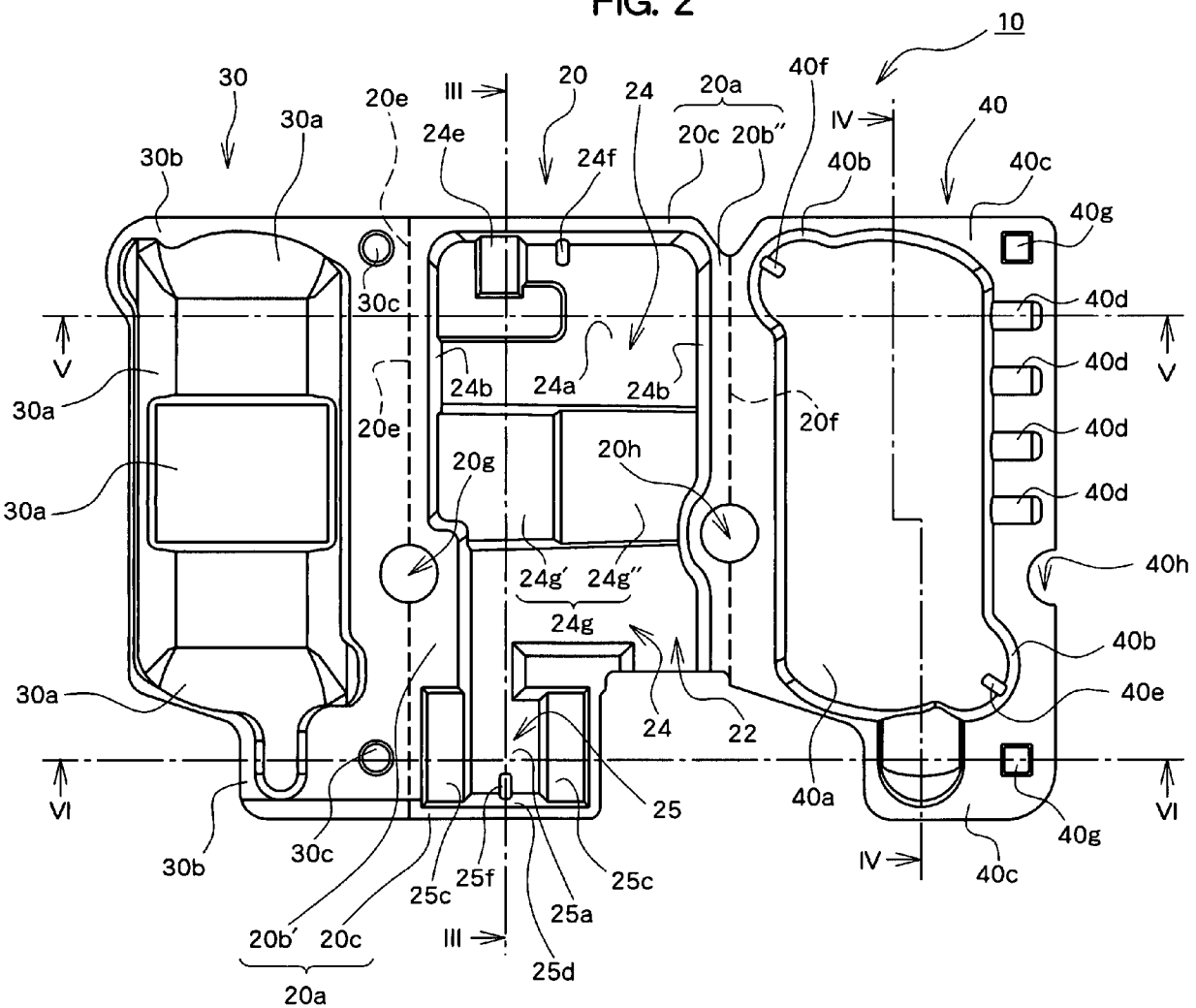
FIG. 2 is a plan view of the container.
Figure 3:
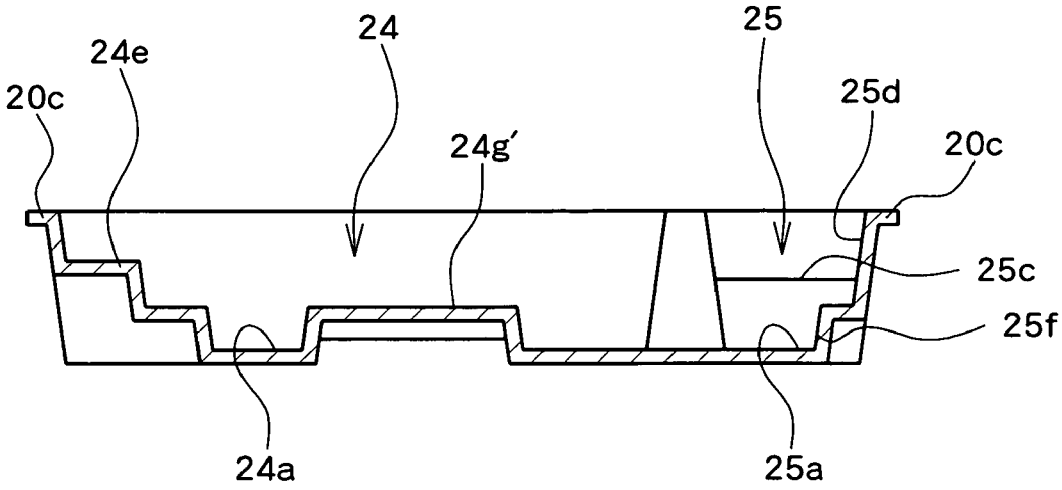
FIG. 3 is a cross-sectional view taken along a line III-III in FIG. 2.
Figure 4:
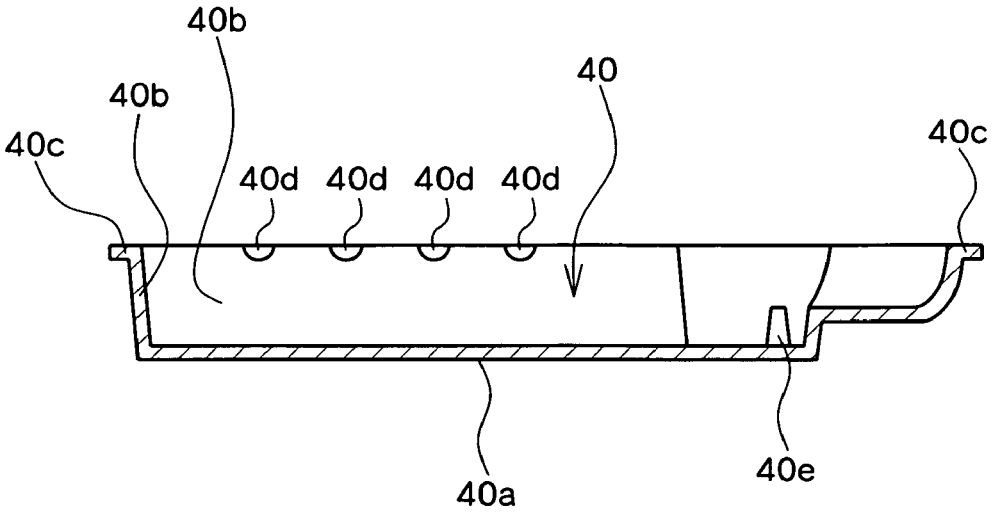
FIG. 4 is a cross-sectional view taken along a line IV-IV in FIG. 2.
Figure 5:
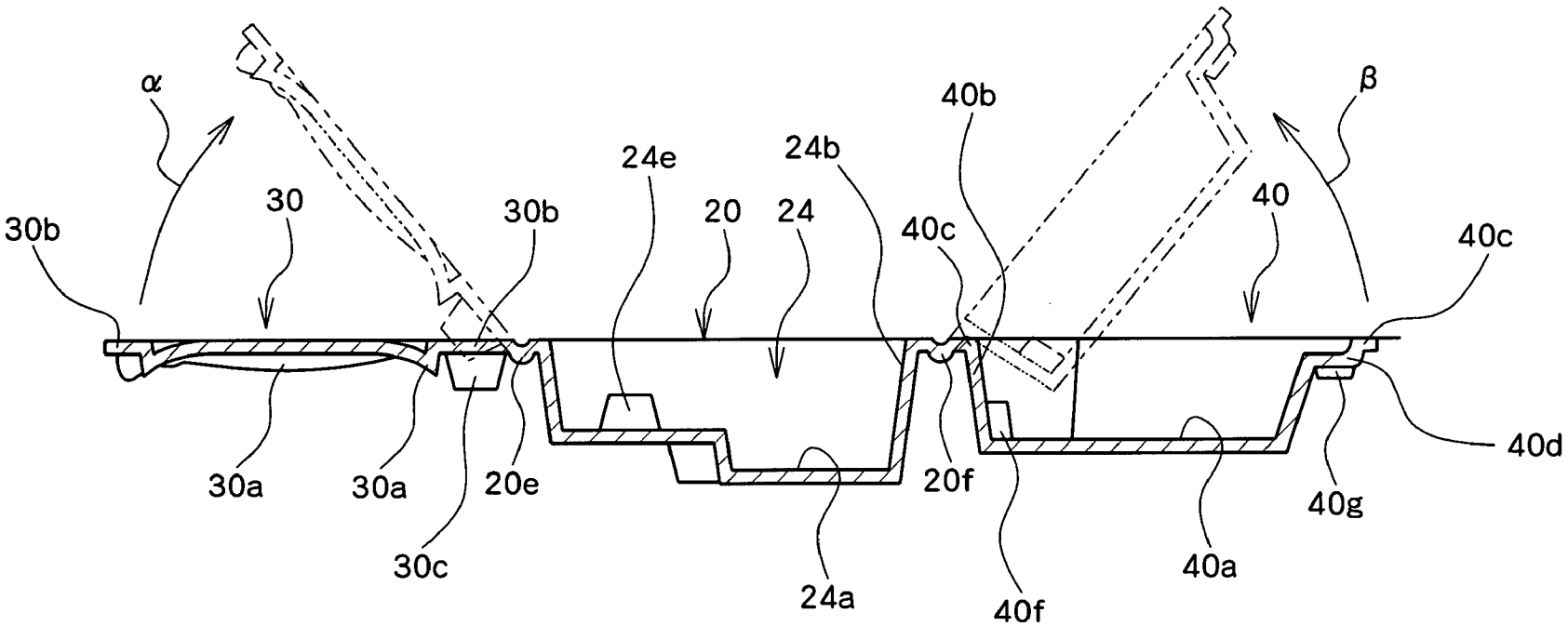
FIG. 5 is a cross-sectional view taken along a line V-V in FIG. 2.
Figure 6:
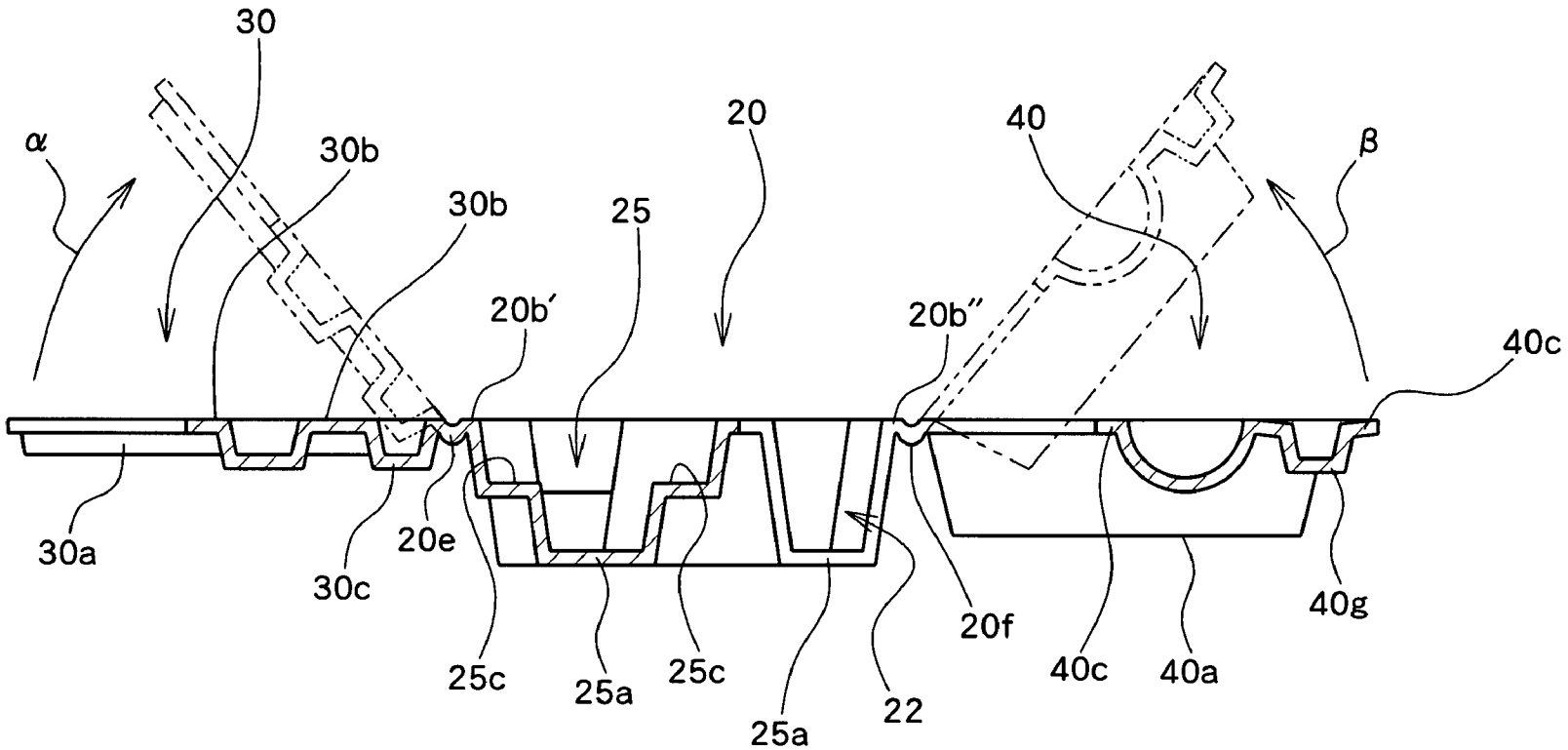
FIG. 6 is a cross-sectional view taken along a line VI-VI in FIG. 2.
Figure 7:
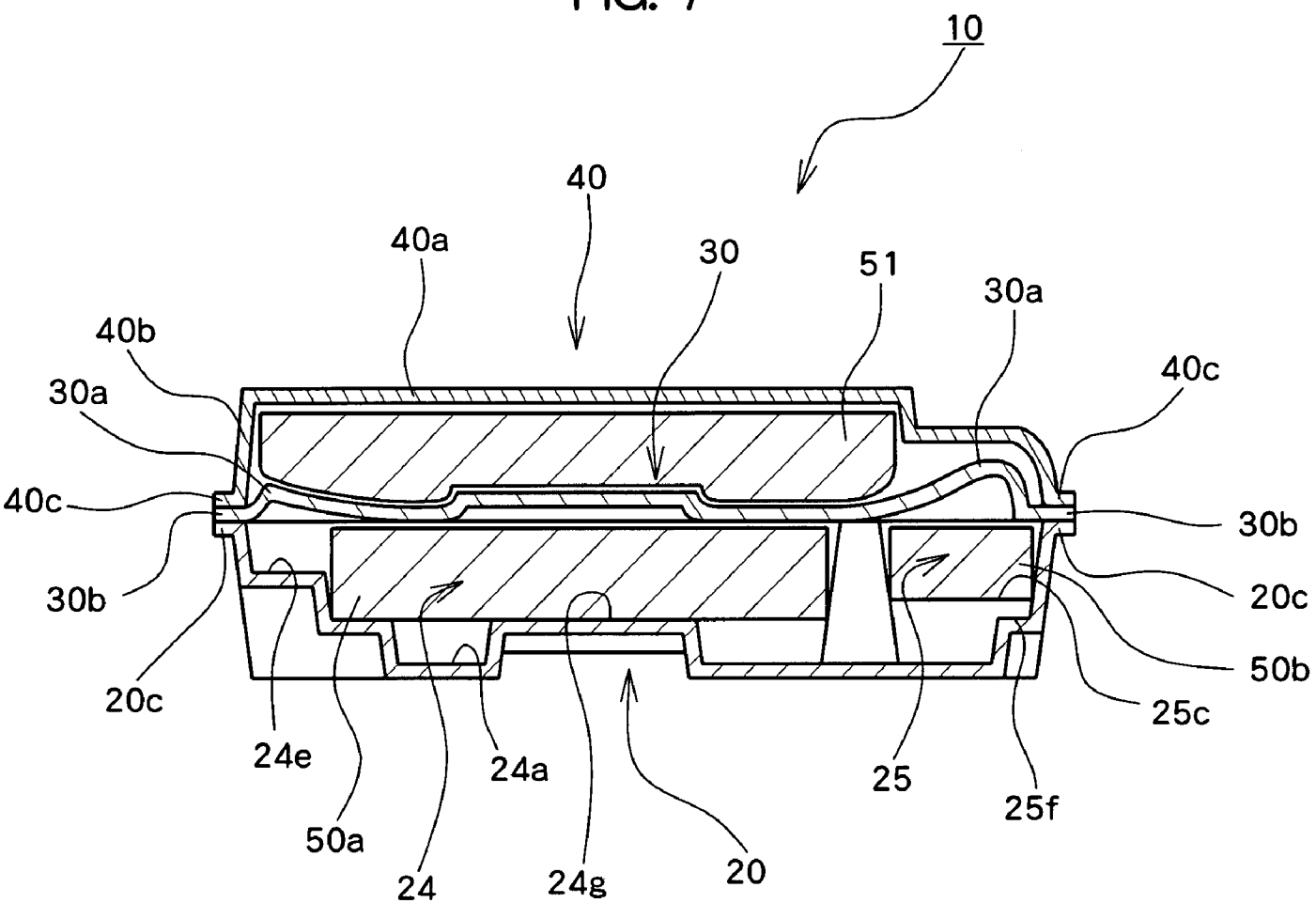
FIG. 7 is a cross-sectional view of the container which stores materials to be stored.

FIG. 1 is a perspective view of a container according to one embodiment of the invention in a state where the container is developed, that is, in a state where the container is not yet assembled, FIG. 2 is a plan view of the container according to this embodiment, FIG. 3 is a cross-sectional view taken along a line III-III in FIG. 2, FIG. 4 is a cross-sectional view taken along a line IV-IV in FIG. 2, FIG. 5 is a cross-sectional view taken along a line V-V in FIG. 2, FIG. 6 is a cross-sectional view taken along a line VI-VI in FIG. 2, and FIG. 7 is a cross-sectional view of the container according to this embodiment in a state where materials to be stored are stored in the container and the container is assembled thereafter.

In this embodiment, the container 10 stores, as shown in FIG. 1, FIG. 2 and FIG. 7, a plurality of accessories such as an adapter, a battery and the like, and a product body such as a portable gaming device, a portable music reproducing device or a mobile phone in a stacked manner. Further, the container 10 is a container which is housed in a package for transportation and also functions as a shock absorber while holding the product body and the like in the package. The container 10 includes a storing recessed portion 20 which stores a plurality of accessories, a partition portion 30 which is connected to the storing recessed portion 20 and is placed on the storing recessed portion 20 after the accessories are stored in the storing recessed portion 20 and forms a base on which the product body is placed, and a lid portion 40 which is connected to the storing recessed portion 20 in the same manner and, after the product body is placed on the partition portion 30, covers the product body from above. These portions are integrally formed using a pulp-mold material.

The storing recessed portion 20 has, as shown in FIG. 1 and FIG. 3, in a state where the container 10 is developed, a schematic box-like shape which has an upper surface thereof opened. The storing recessed portion 20 has a shape in which a corner portion thereof is cut in a square shape in a plan view, and has an opening portion 22 which opens sidewards. The inside of the storing recessed portion 20 is defined into a first storing chamber 24 which accommodates a first accessory 50*a* (for example, an adaptor or the like) and a second storing chamber 25 which accommodates a second accessory 50*b* (for example, a battery or the like).

The first storing chamber 24 is formed in conformity with a shape of the first accessory 50*a* to function as a shock absorbing material (see FIG. 7). To be more specific, the first storing chamber 24 is surrounded by a bottom wall 24*a* having an approximately square shape in a plan view and a side wall 24*b* which juts up from a periphery of the bottom wall 24*a*. A table portion 24*g* which bulges out in a trapezoidal cross-sectional shape is formed in the vicinity of the longitudinal center of the bottom wall 24*a*. The table portion 24*g* extends from the side wall 24*b* of the one side to the side wall 24*b* of the another side (see FIG. 3). The table portion 24*g* has a stepped portion and includes a high table portion 24*g*' which bulges upwardly from a lowermost surface of the bottom wall 24*a* and a low table portion 24*g*" which is lower than the high table portion 24*g*' in height. The high table portion 24*g*' supports the first accessory 50*a* thus more effectively absorbing the shock at the time of transportation. Further, since the table portion 24*g* decreases a flat-surface wall portion by forming the stepped portion thus increasing the strength of the container 10. Further, on a corner of a lower portion of the first storing chamber 24, a step-like convex portion 24*e* which bulges toward the inside of the first storing chamber 24 in a step-like manner in conformity with the shape of the first accessory 50*a* is formed (see FIG. 5). The step-like convex portion 24*e* also increases a shock absorbing function and the strength of the container 10.

The above-mentioned opening portion 22 is formed in a portion of the side wall 24*b* of the first storing chamber 24. In the inside of the first storing chamber 24, as mentioned above, the accessory such as an adaptor, for example, is stored. With respect to the adaptor which uses various kinds of power source plugs as parts thereof, the accessory is formed in various types. In storing such an accessory in the first storing chamber 24, only the part like the plugs is arranged outside the container 10 from the opening portion 22. Accordingly, it is unnecessary to change the shape of the container 10 depending on the types of parts and hence, it is possible to realize the container 10 which exhibits excellent productivity.

The second storing chamber 25 is formed in conformity with the second accessory 50*b* such that the second storing chamber 25 has a function of a shock absorbing material (see FIG. 7). To be more specific, the second storing chamber 25 has a shape which is bent from left and right sides in a step-like manner from a brim portion 20*a* of the storing recessed portion 20 toward the bottom wall 25*a* of the second storing chamber 25 and has a holding bottom wall 25*c* at a position higher than the bottom wall 25*a* (see FIG. 6). The second accessory 50*b* is held in the second storing chamber 25 in a state where the second accessory 50*b* is placed on the holding bottom wall 25*c*.

On the bottom wall 25*a* of the second storing chamber 25, a projecting fragment portion 25*f* which juts up along a side wall 25*d* is formed. Further, on the bottom wall 24*a* of the first storing chamber 24, a projecting fragment portion 24*f* which juts up along a side wall 24*c* is molded. These projecting fragment portions 24*f*, 25*f* prevent a phenomenon that when a plurality of containers 10 are stacked, the containers 10 are firmly engaged with each other by fitting so that the containers 10 cannot be separated from each other.

The brim portion 20*a* of the storing recessed portion 20 has a flange shape which extends outwardly. When the assembled container 10 is stored in the inside of the package, the brim portion 20*a* is brought into contact with an inner surface of the package, and hence the function of the container 10 as a shock absorbing material is increased.

The partition portion 30 has an approximately plate-like shape and has a brim portion 30*b* thereof connected to the storing recessed portion 20. To be more specific, as shown in FIG. 1 or FIG. 2, a linear bending brim portion 20*e* is formed on the longitudinal brim portion 20*b*' of the storing recessed portion 20 and the partition portion 30 is connected to the storing recessed portion 20 at the bending brim portion 20*e*. The bending brim portion 20*e* is recessed slightly downwards in a semicircular cross-sectional shape to allow the partition portion 30 to be foldable toward the storing recessed portion 20 side (see FIG. 5). To guide the position of a product body 51 on the partition portion 30, a guide portion 30*a* which is recessed downwardly in a state where the container 10 is developed is formed on the partition portion 30 in conformity with a lower surface of the product body (see FIG. 1, FIG. 5, FIG. 7). When the partition portion 30 is folded to the storing recessed portion 20 side (the direction indicated by a in FIG. 1, FIG. 5, FIG. 6) using the bending brim portion 20*e* as the center, the partition portion 30 is placed on the brim portion 20*a* of the storing recessed portion 20 so as to close the opening formed in the upper surface of the storing recessed portion 20. Therefore, the guide portion 30*a* which is recessed downwardly in a state where the container 10 is developed is bulged upwardly and the product body is placed on the partition portion 30 in conformity with the guide portion 30*a* (see FIG. 7).

A linear bending brim portion 20*f* is formed also on the brim portion 20*b*" on a side opposite to the side to which the partition portion 30 is connected. The lid portion 40 is connected to the storing recessed portion 20 by the bending brim portion 20*f* (see FIG. 1 or FIG. 2). To allow the lid portion 40 to be foldable toward the storing recessed portion 20 side, the bending brim portion 20*f* is also slightly recessed downwardly in a semicircular cross-sectional shape (FIG. 5). The lid portion 40 is molded in conformity with the shape of the product body in general. After the partition portion 30 is folded to the storing recessed portion 20 side, the lid portion 40 is folded toward the storing recessed portion 20 side (in the direction indicated by β in FIG. 1, FIG. 5 and FIG. 6) using the bending brim portion 20*f* as the center. Then, a brim portion 40*c* of the lid portion 40 is brought into contact with the brim portion 30*b* of the partition portion 30, and the lid portion 40 covers a product body 51 from above (see FIG. 7).

Here, on the brim portion 40*c* of the lid portion 40, a plurality of reinforcing ribs 40*d* which are recessed downwardly when the container 10 is in a developed state are formed (see FIG. 1 or FIG. 4). Further, on a bottom wall 40*a* of the lid portion 40, projecting fragment portions 40*e*, 40*f* which jut up along the side wall 40*b* are molded (see FIG. 2). These projecting fragment portions 40*e*, 40*f*, in the same manner as the projecting fragment portions 24*f*, 25*f* of the storing recessed portion 20, also prevent a phenomenon that when a plurality of containers 10 are stacked, the containers 10 are firmly engaged with each other by fitting so that the containers 10 cannot be separated from each other.

The storing recessed portion 20, the lid portion 40 and the partition portion 30 are formed such that all of these portions are recessed in the same direction from the brim portions thereof in a state where the container 10 is developed. That is, as described above, the storing recessed portion 20 is recessed downwardly in conformity with the shape of the accessory. The lid portion 40 is formed in a downwardly recessed manner in conformity with the shape of the product body in a state where the container 10 is developed. Reinforcing ribs 40*d* which are formed on a brim portion 40*c* of the lid portion 40 are also recessed downwardly. Guides 30*a* which are formed on the partition portion 30 to indicate the placing position of the product body 50 are also recessed downwardly in a state where the container 10 is developed. In this manner, the storing recessed portion 20, the lid portion 40, the reinforcing ribs 40*d* and the guide portions 30*a* of the partition portion 30 are recessed downwardly from the respective brim portions 20*a*, 40*c*, 30*d*. By forming the container 10 in such a shape, the manufacture of the container 10 is facilitated.

A brim portion 30*b* of the partition portion 30 and a brim portion 40*c* of the lid portion 40 are, in the same manner as the brim portion 20*a* of the storing recessed portion 20, formed in a flange shape which extends outwardly. The brim portion 30*b* of the partition portion 30, the brim portion 40*c* of the lid portion 40 and the brim portion 20*a* of the storing recessed portion 20 are formed on a coplanar plane. Accordingly, when the partition portion 30 is folded toward the storing recessed portion 20 side and, thereafter, the lid portion 40 is folded toward the storing recessed portion 20 side, the respective brim portions are brought into contact with each other without gaps. Accordingly, the aesthetic appearance of the container 10 after the product body 51 and the accessories 50*a*, 50*b* are stored therein can be enhanced and, at the same time, these materials to be stored can be more surely supported in the inside of the container 10.

As shown in FIG. 1 and FIG. 2, in the brim portion 30*b* of the partition portion 30 and the longitudinal brim portion 20*b*' of the storing recessed portion 20, a circular hole 20*g* which spans over a bending brim portion 20*e* is formed. Further, a semicircular notch 40*h* is formed in the brim portion 40*c* of the lid portion 40, wherein the notch 40*h* is formed at a position at which the notch 40*h* corresponds to the hole 20*g* when the lid portion 40 is folded toward the storing recessed portion 20. A brim of the hole 20*g* and a brim of the notch 40*h* form, when the partition portion 30 and the lid portion 40 are folded to the storing recessed portion 20 side and the container 10 is assembled, a recessed portion which is recessed in a semicircular shape in a plan view. In the same manner, also in the brim portion 40*c* of the lid portion 40 and the longitudinal brim portion 20*b*" of the storing recessed portion 20, a circular hole 20*h* which spans over a bending brim portion 20*f* is formed. The hole 20*h* also forms, when the partition portion 30 and the lid portion 40 are folded to the storing recessed portion 20 side and the container 10 is assembled, a recessed portion which is recessed in a semicircular shape in a plan view. These recessed portions are, when the container 10 is stored in a package for transportation or is taken out from the package, pinched by fingers of a packing operator or a consumer thus facilitating the takeout operation and the packing operation.

In the brim portion 30*b* of the partition portion 30, lower engaging portions 30*c* which are recessed downwardly in a state where the container 10 is developed and have a circular shape in a plan view are formed. On the other hand, in the brim portion 40*c* of the lid portion 40, upper engaging portions 40*g* having a square shape in a plan view which are recessed downwardly in a state where the container 10 is developed are formed, wherein the upper engaging portions 40*g* are formed at positions which correspond to the lower engaging portions 30*c*. When the partition portion 30 is folded toward the storing recessed portion 20 side and, thereafter, the lid portion 40 is folded toward the storing recessed portion 20 side, the lower engaging portions 30*c* are fitted in the upper engaging portions 40*g*. Accordingly, the lid portion 40 is fixed to the partition portion 30, and hence the product body 51 is surely supported in the inside of the container 10. Here, the lower engaging portions 30*c* and the upper engaging portions 40*g* are recessed downwardly in a state where the container 10 is developed, and hence, the recessing directions of the respective portions of the container 10 are set in the same direction. That is, the storing recessed portion 20, the partition portion 30, the lower engaging portions 30*c*, the lid portion 40, and the upper engaging portion 40*g* are recessed downwardly from the respective brim portions in a state where the container 10 is developed. Due to such a constitution, the manufacture of the container 10 is facilitated.

According to the container 10 of this embodiment, since the product body 51 and the accessories 50*a*, 50*b* are stored in a stacked manner in the container 10, it is possible to realize the container 10 which can store the materials to be stored in a compact manner. Further, the partition portion 30 is provided between the accessories 50*a*, 50*b* and the product body 51, and hence it is possible to prevent these devices from being mixed together in the inside of the container 10 during transportation.

Figure 8:
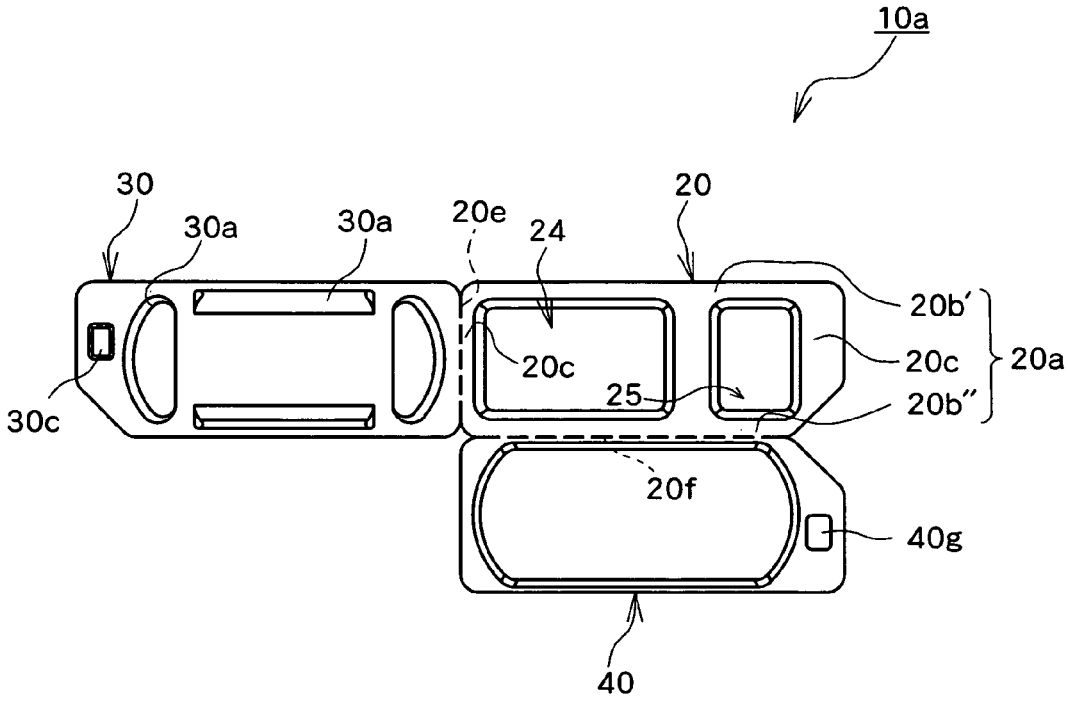
FIG. 8 is a plan view of a container according to another embodiment of the invention.

Here, the invention is not limited to the above-mentioned embodiment and various modifications are conceivable. For example, the lid portion 40 is connected to the longitudinal brim portion 20*b*" on the side opposite to the partition portion 30 with the storing recessed portion 20 sandwiched between the lid portion 40 and the partition portion 30 in the above-mentioned container 10. However, the positions of the lid portion 40 and the partition portion 30 are not limited to such positions. As in the case of a container 10*a* shown in FIG. 8, the container 10*a* may be configured such that the lid portion 40 is connected to the longitudinal brim portion 20*b*" of the storing recessed portion 20 and, at the same time, the partition portion 30 is connected to a lateral brim portion 20*c* of the storing recessed portion 20. Here, in this drawing, parts identical with the parts of the above-mentioned container 10 are given same numerals and only the main constitution of the container is shown. Further, also in this container 10*a*, in the same manner as the container 10, the storing recessed portion 20, the partition portion 30 and the lid portion 40 are recessed in the same direction from the respective brim portions, in a state where the container 10*a* is developed.

Further, in the above-mentioned embodiment, the upper engaging portions 40*g* which are formed in the brim portion 40*c* of the lid portion 40 are recessed downwardly, in a state where the container 10 is developed. However, the upper engaging portions 40*g* are not limited to the recessed shape and may be formed of a hole having a diameter substantially equal to a diameter of the lower engaging portions 30*c*, for example. In this case, the lower engaging portions 30*c* are fitted in the upper engaging portions 40*g* so as to fix the lid portion 40 to the partition portion 30.

Figure 9:
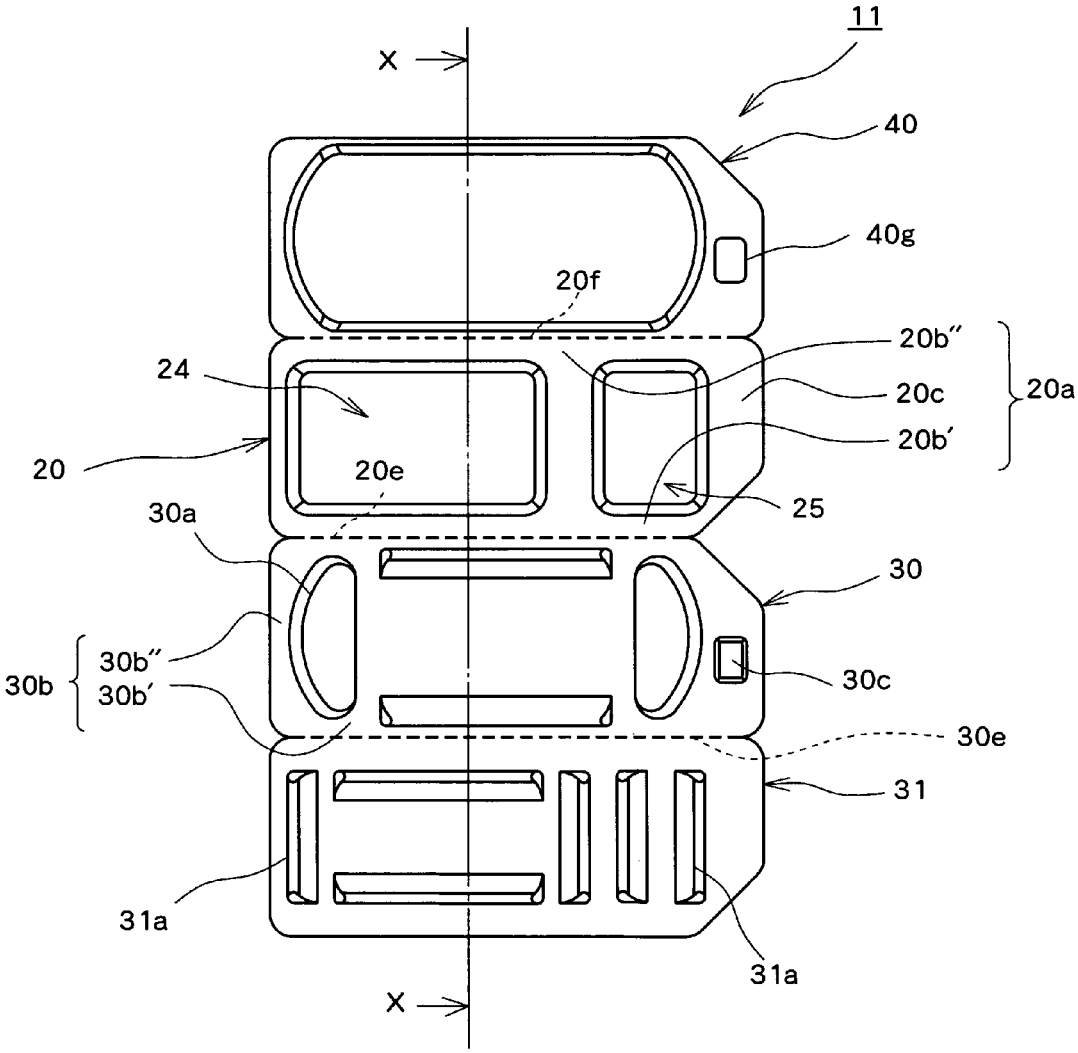
FIG. 9 is a plan view of a container according to still another embodiment of the invention.
Figure 10:
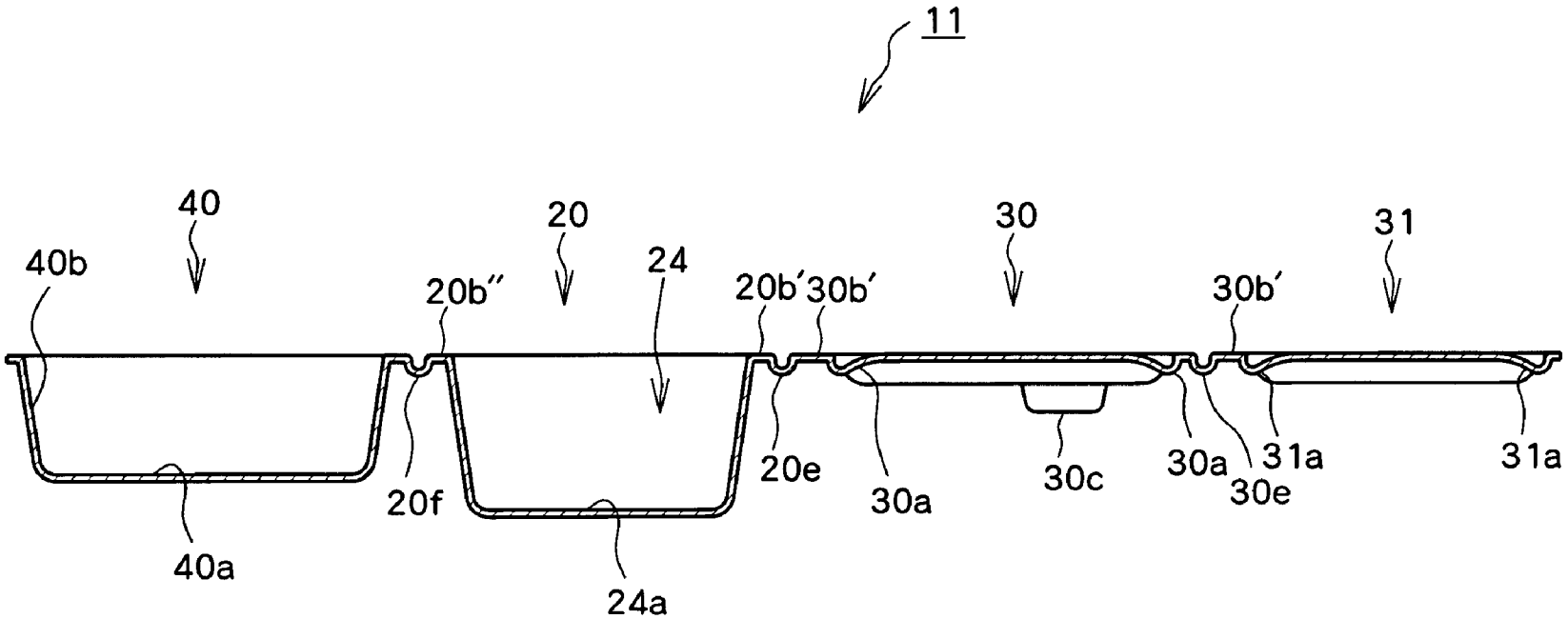
FIG. 10 is a cross-sectional view taken along a line X-X in FIG. 9.

Further, the container 10 may include two partition portions thus increasing strength of the container against an external force from the side and, at the same time, allowing a thin accessory (for example, a thin device, a manual on a product or the like) to be stored between two partition portions. FIG. 9 is a plan view showing a container 11 having such a configuration in a state that the container 11 is developed, and FIG. 10 is a cross-sectional view taken along a line X-X in FIG. 9. In these drawings, parts identical with the parts of the above-mentioned container 10 are given the same numerals and only the main constitution of the container is shown.

As shown in FIG. 9, in the container 11, besides the above-explained partition portion 30 on which the guide for indicating the position of the product body 51 is formed, a holding partition portion 31 is provided. On the holding partition portion 31, guide portions 31*a* which are recessed downwardly in conformity with shapes of upper surfaces of the accessories 50*a*, 50*b* are formed, wherein these guide portions 31*a* suppress the tilting of the accessories 50*a*, 50*b* in the inside of the container 11. As shown in FIG. 10, in a state where the container 11 is developed, the guide portions 31*a* are recessed in the same direction as the recessing directions of the respective portions of the container 11. Due to such a constitution, the manufacture of the container 11 is further facilitated. The partition portion 30 is connected to the longitudinal brim portion 20*b*' of the storing recessed portion 20. The holding partition portion 31 is connected to a bending brim portion 30*e* which is formed at a longitudinal brim portion 30*b*' on a side of the partition portion 30 opposite to the storing recessed portion 20. The lid portion 40 is connected to the brim portion 20" of the storing recessed portion 20 opposite to the partition portion 30.

The container 11 is assembled by sequentially folding the holding partition portion 31, the partition portion 30 and the lid portion 40 toward the storing recessed portion 20 side from the respective bending brim portions. To be more specific, the above-mentioned thin accessory is placed on the partition portion 30, and the holding partition portion 31 is folded toward the partition portion 30 side using the bending brim portion 30*e* as the center. Then, the partition portion 30 and the holding partition portion 31, and the thin accessory which is sandwiched between the partition portion 30 and the holding partition portion 31 are integrally folded toward the storing recessed portion 20 side. Here, the partition portion 30 is placed on the storing recessed portion 20 together with the holding partition portion 31 and the thin accessory, wherein the guide portions 30*a* of the partition portion 30 assume an upwardly bulged state. On the other hand, the guide portions 31*a* of the holding partition portion 31 assume a state in which the guide portions 31*a* are bulged toward a side (lower side) of the accessories 50*a*, 50*b* which are stored in the storing recessed portion 20 thus suppressing the tilting of these accessories 50*a*, 50*b*. Then, when the product body 51 is placed on the partition portion 30 and, thereafter, the lid portion 40 is folded toward the storing recessed portion 20 side, the lid portion 40 covers the product body 51 from above thus assembling the container 11. Here, in the above-mentioned container 11, the holding partition portion 31 includes the guide portions 31*a*. However, even when the holding partition portion 31 has no guide portions 31*a* and is formed in a plate-like shape, the holding partition portion 31 can increase the strength against external force from the side and, at the same time, it is possible to hold the thin device or the like between the partition portion 30 and the holding partition portion 31.

Figure 11A:
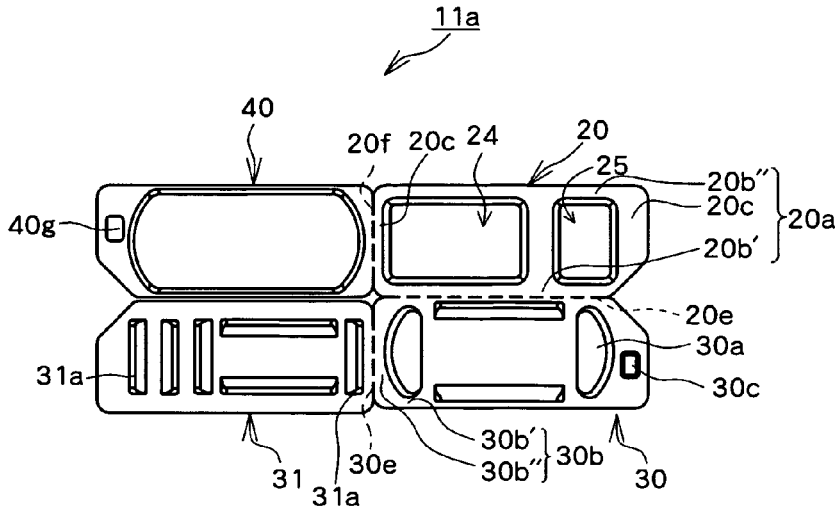
FIG. 11A to 11C are plan views of a container according to still another embodiment of the invention.
Figure 11B:
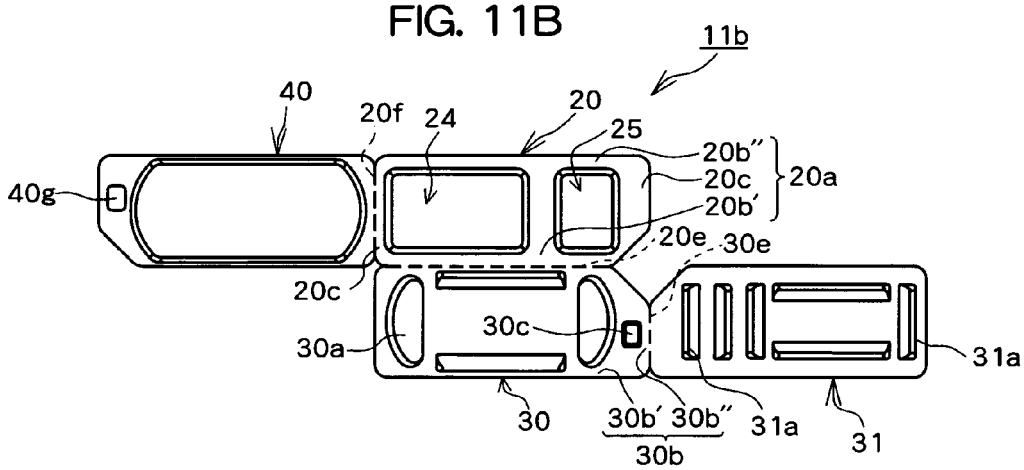
Figure 11C:
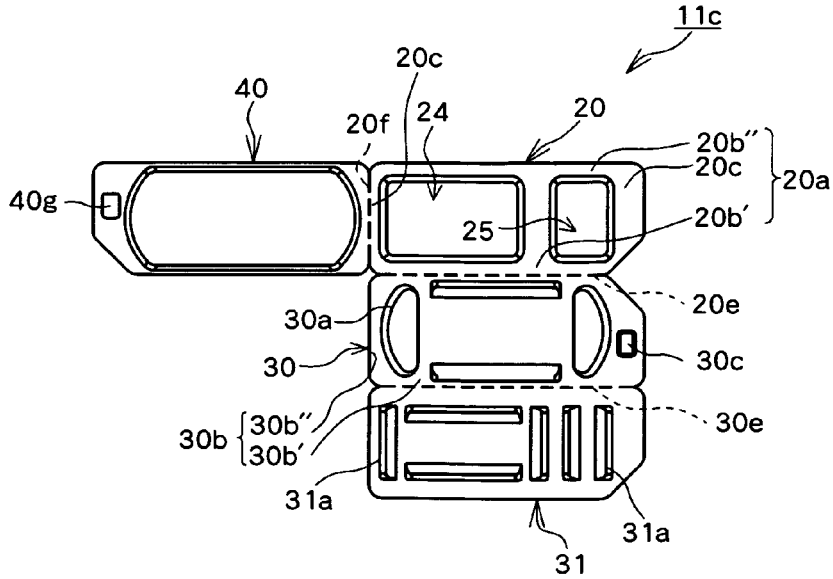

FIG. 11A to FIG. 11C are plan views showing another example of the container having the holding partition portion 31. In a container 11*a* shown in FIG. 11A, the partition portion 30 is connected to the longitudinal brim portion 20*b*' of the storing recessed portion 20, and the holding partition portion 31 is connected to the lateral brim portion 30*b*" of the partition portion 30. The lateral brim portions 20*c* are formed on the storing recessed portion 20, and the lid portion 40 is connected to the brim portion 20*c* formed in the same side as the side where the holding partition portion 31 is provided. Further, in a container 11*b* shown in FIG. 11B, the partition portion 30 is connected to the longitudinal brim portion 20*b*' of the storing recessed portion 20, and the holding partition portion 31 is connected to the lateral brim portion 30*b*" of the partition portion 30. The lateral brim portions 20*c* are formed on the storing recessed portion 20, and the lid portion 40 is connected to the brim portion 20*c* formed in the same side as the side where the holding partition portion 31 is provided. In a container 11*c* shown in FIG. 11C, the partition portion 30 is connected to the longitudinal brim portion 20*b*' of the storing recessed portion 20. The longitudinal brim portions 30*b*' are formed on the partition portion 30, and the holding partition portion 31 is connected to the brim portion 30*b*' formed in the side opposite to the side where the storing recessed portion 20 is provided. The lid portion 40 is connected to the lateral brim portion 20*c* of the storing recessed portion 20. Here, also with respect to the containers 11*a*, 11*b*, 11*c* which have been explained heretofore, the container 20, the partition portion 30, the lid portion 40 and the holding partition portion 31 are recessed in the same direction from the respective brim portions in a state where the container is developed. Accordingly, the manufacture of the containers can be facilitated.

In assembling the containers 11*a*, 11*b*, 11*c* shown in FIG. 11A to FIG. 11C, in the same manner as the container 11 shown in FIG. 9, first of all, the holding partition portion 31 is folded toward the partition portion 30 side and, subsequently, the holding partition portion 31 and the partition portion 30 are integrally folded toward the storing recessed portion 20 side, and finally, the lid portion 40 is folded toward the storing recessed portion 20 side.

According to the container having the holding partition portion 31 which has been explained above, even when the third material to be stored is stored in addition to the first material to be stored and the second material to be stored, these materials to be stored are stored in a stacked manner, and hence it is possible to provide the container which can store a plurality of materials to be stored in a compact manner. Further, the invention can realize a container which exhibits strong resistance against external force from the side.

Here, any one of the containers which have been explained heretofore is configured such that the respective portions are recessed downwardly in the state where the container is developed. However, for example, the guide portions 30*a* of the partition portion 30, the guide portions 31*a* of the holding partition portion 31, the reinforcing ribs 40*d* and the like may be formed such that these portions are partially bulged upwardly from the respective brim portions in the state where the container is developed.

What is claimed is:

1. A molded pulp container comprising:

a storing recessed portion having an opening at an upper surface thereof;

a first partition portion connected to the storing recessed portion by a first bending brim portion formed on a portion of a brim portion of the opening of the storing recessed portion, the first partition portion being foldable toward the storing recessed portion side at the first bending brim portion, the first partition portion forming a base for an upper storing chamber, wherein when the partition portion is folded over the storing recess portion, the first partition portion closes the opening of the storing recess portion forming a lower storing chamber;

a lid portion connected to the storing recessed portion by a second bending brim portion formed on another portion of the brim portion of the storing recessed portion, the lid portion being foldable toward the storing recessed portion side at the second bending brim portion to cover the first partition portion from above, wherein the lid portion has a bottom wall and a side wall projecting from a periphery of the bottom wall, and the bottom wall, side wall, and partition portions forming the upper storing chamber above the lower storing chamber when the lid portion is folded over the storing recess portion; and a second partition portion which is foldable and formed so as to be disposed between the upper storing chamber and the lower storing chamber together with the first partition portion when the second partition portion is folded, wherein first and second guide portions which project downward or upward are formed on the first and second partition portions.

2. A molded pulp container according to claim 1, wherein the storing recessed portion and the lid portion are, in a state before the lid portion is folded to the storing recessed portion side, recessed in the same direction from the respective brim portions.

3. A molded pulp container according to claim 1, wherein the first partition portion has a plate-like shape.

4. A molded pulp container according to claim 3, wherein the storing recessed portion, the lid portion and the first partition portion are, in a state where the container is developed, recessed in the same direction from the respective brim portions.

5. A molded pulp container according to claim 1, wherein the storing recessed portion, the first partition portion and the lid portion are integrally molded.

6. A molded pulp container according to claim 1, wherein the brim portion of the storing recessed portion is formed in a flange shape that extends outwardly.

7. A molded pulp container according to claim 1, wherein the peripheral portion of the storing recessed portion, the peripheral portion of the first partition portion and the peripheral portion of the lid portion are arranged on a coplanar plane.

8. A molded pulp container according to claim 1, wherein the brim portion of the first partition portion includes, a convex lower engaging portion which projects upwardly in a state where the first partition portion is folded toward the storing recessed portion side, while the brim portion of the lid portion includes an upper engaging portion which is engaged with the lower engaging portion, at a position where the lower engaging portion faces in a state where the lid portion is folded toward the storing recessed portion side.

9. A molded pulp container according to claim 8, wherein the upper engaging portion is formed in a convex shape which projects upwardly in a state where the lid portion is folded toward the storing recessed portion side, and the storing recessed portion, the lid portion, the upper engaging portion, the first partition portion, and the lower engaging portion are, in a state where the container is developed, recessed in the same direction from the respective brim portions.

10. A molded pulp container according to claim 1, wherein the storing recessed portion, the first partition portion, and the lid portion are, in a state where the container is developed, recessed in the same direction from the respective brim portions.

11. A molded pulp container according to claim 1, wherein the second partition portion is connected to the brim of the first partition portion so as to be foldable toward the first partition portion, and the second partition portion is foldable toward the storing recessed portion together with the first partition portion.

* * * * *